US007190343B2

(12) United States Patent
Baek et al.

(10) Patent No.: US 7,190,343 B2
(45) Date of Patent: Mar. 13, 2007

(54) LIQUID CRYSTAL DISPLAY AND DRIVING METHOD THEREOF

(75) Inventors: Jong Sang Baek, Kyoungsangbuk-do (KR); Sun Young Kwon, Kyoungsangbuk-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 639 days.

(21) Appl. No.: 10/669,442

(22) Filed: Sep. 25, 2003

(65) Prior Publication Data

US 2004/0100435 A1 May 27, 2004

(30) Foreign Application Priority Data

Nov. 22, 2002 (KR) ..... 10-2002-0073086

(51) Int. Cl.
*G09G 3/36* (2006.01)

(52) U.S. Cl. ..... 345/100; 345/211; 345/212; 345/213

(58) Field of Classification Search ..... 345/100, 345/211, 212, 213
See application file for complete search history.

(56) References Cited

U.S. PATENT DOCUMENTS 6,418,002 B1 * 7/2002 Yang et al. ..... 361/90

* cited by examiner

*Primary Examiner*—Richard Hjerpe
*Assistant Examiner*—Leonid Shapiro
(74) *Attorney, Agent, or Firm*—Morgan, Lewis & Bockius, LLP

(57) ABSTRACT

A liquid crystal display including a gate driver driving gate lines on a liquid crystal display panel, a timing controller controlling the gate driver, and a masking part selectively intercepting a gate output enable signal corresponding to an abnormal state of a gate high voltage, wherein the gate output enable signal is supplied to the gate driver from the timing controller.

12 Claims, 8 Drawing Sheets

LIQUID CRYSTAL DISPLAY AND DRIVING METHOD THEREOF

This application claims the benefit of the Korean Patent Application No. P2002-73086 filed in Korea on Nov. 22, 2002, which is hereby incorporated by reference.

BACKGROUND OF THE INVENTION

1. Field of the Invention

The present invention relates to a liquid crystal display, and more particularly to a liquid crystal display and a driving method thereof for preventing a gate driver from generating an abnormal output.

2. Description of the Related Art

Generally, liquid crystal displays (hereinafter, referred to as LCD) are used as the monitors of computer notebooks to control the light transmittance of liquid crystals using an electric field, thereby displaying pictures corresponding to video signals. Such an LCD, as shown in FIG. 1, includes a liquid crystal display panel 1 where liquid crystal cells are arranged in a matrix and a drive circuit to drive the liquid crystal display panel. The liquid crystal display panel 1 includes a thin film transistor MN (hereinafter, referred to as TFT MN) formed adjacent each intersection of gate lines GL1 and GL2, and data lines DL1 and DL2 to switch a signal voltage that is supplied to a liquid crystal cell Clc to control the light transmittance of a liquid crystal cell Clc in accordance with the voltage level of each video signal. In response to a gate signal from the gate line, the TFT MN supplies the video signal from the data line to the liquid crystal cell Clc. The liquid crystal cell Clc includes a common electrode and a pixel electrode (not shown), which face each other with liquid crystals therebetween. The pixel electrode (not shown) is connected to the TFT MN. The pixel electrode is formed at a cell area defined by the gate line and data line, which cross each other perpendicularly.

The drive circuit includes a gate diver 3 to drive the gate lines on the liquid crystal display panel, a data driver 15 to drive the data lines on the liquid crystal display panel 1, and a timing controller 9. The timing controller 9 supplies a timing control signal to the gate driver 3 and the data driver 5 to control them and, in addition, supplies a pixel data to the data driver 5. Further, the drive circuit includes a power supply 11 to supply a power supply voltage for driving the whole system, and a masking part 7 to mask a gate output enable signal (hereinafter, referred to as GOE) that is one of control signals to be applied to the gate driver 3.

The data driver 5 inputs a data control signal, such as a data clock, etc., together with red R, green G and blue B data signals from the timing controller 9. The data driver 5 acts to apply pixel signals corresponding to the pixel data of one line to the data line whenever the gate signal (or a scan signal) from the gate driver is applied to the gate line. The gate driver 3 sequentially applies the gate signal to the gate lines to sequentially drive the gate lines for each horizontal synchronization signal period. In other words, the gate driver 3 acts to generate the gate signal (or the scan signal) that sequentially selects the gate line. A gate high voltage is applied to each gate line only for the corresponding vertical synchronization period, and a gate low voltage is applied to each gate line for the remaining period. The video data on the data line is supplied to the pixel electrode of the liquid crystal cell Clc through the TFT MN in response to the gate signal (or scan signal) input from the gate driver 3.

The timing controller 9 controls the drive timing of the gate driver 3 and the data driver 5 in response to horizontal and vertical synchronization signals and a data clock input from an external source, such as a graphic card within a computer system. The timing controller 9 generates the control signals for the gate driver 3 and the data driver 5, including a gate output enable signal GOE and a data output enable signal, using the data clock, the horizontal and vertical synchronization signals. Further, the timing controller 9 supplies an input video data signal R, G and B from an external source to the data driver 5.

The power supply part 11 supplies a power supply voltage to each circuit part for driving the whole system. The masking part 7 selectively masks the gate output enable signal GOE that designates an output point in time of the gate driver 3 in accordance with the logic state of a reset signal. FIG. 2 is a diagram illustrating a detailed configuration of a masking part in FIG. 1. FIG. 3 is a waveform diagram of input and output signals of the masking part of FIG. 2. The masking part shown in FIG. 2 will be explained in conjunction with the waveforms shown in FIG. 3.

Referring to FIG. 2, the masking part 7 includes a first D flip-flop 21*a* (hereinafter, referred to as F/F) to a sixth D F/F 21*f* receiving a vertical synchronization signal BVSY at their clock terminal CLK through a first inverter 23*a* from a synchronization signal input terminal 17, and an AND-gate 25 to perform a logical product operation on a reset signal RESET from a reset input terminal 19 and an output signal of the first D F/F 21*a*. Further, the masking part 7 includes an OR-gate 27 to switch the gate output enable signal GOE from the timing controller 9 in accordance with the output signals from second and third inverters 23*b* and 23*c*.

Each of the D F/F's 21*a–f* latches the input signal at its input terminal D to its output terminal Q at the point in time when the inverted vertical synchronization signal from the first inverter 23*a*, which is supplied to its clock terminal CLK, is changed from low state to high state, that is as at the rising edge of the inverted vertical synchronization signal BVSY Further, each D F/F 21 receives the power supply voltage Vcc at its preset input terminal PR. In addition, each D F/F 21 receives the reset signal RESET at its clear terminal CLR. While the reset signal RESET is in a low logic state, each D F/F 21 initializes the output terminal Q and the inversion output terminal Q. A signal coming out from the inversion output terminal Q has an opposite polarity to the output signal from an output terminal Q.

As further shown in FIG. 3, the power supply voltage Vcc and the reset signal RESET remain at a normal voltage since power is supplied. The first D F/F 21*a* receives the reset signal RESET from the reset input terminal 19 at its input terminal D, and inversely receives the vertical synchronization signal BVSY from the synchronization signal input terminal 17 at the clock terminal CLK through the first inverter 23*a*. Further, the first D F/F 21*a* latches the reset signal RESET input at its input terminal D to its output terminal Q at the point in time when the vertical synchronization signal BVSY inversely input at the clock terminal CLK is first changed from low state to high state, that is at the rising edge of the inverted vertical synchronization signal BVSY Accordingly, the first D F/F 21 Aadelays the reset signal RESET for a period corresponding to one vertical synchronization signal.

The AND gate 25 shown in FIG. 2 is connected between the output terminal Q of the first D F/F 21*a* and the input terminal D of the second D F/F 21*b*, and performs a logical product operation on the reset signal RESET first-delayed at the output terminal Q of the first D F/F 21*a* and the reset signal RESET input from the reset input terminal 19. Further, the AND-gate 25 ensures that the signal output at the output terminal Q of the first D F/F 21*a* is input to the input terminal D of the second D F/F 21*b*. However, it is indifferent to the presence or absence of the AND-gate 25.

The second D F/F 21*b* receives the output signal, on which logical product operation is performed by the AND-gate 25, at its input terminal D and the inverted vertical synchronization signal BVSY at the clock terminal CLK through the first inverter 23*a*. The signal coming out at the output terminal Q of the second D F/F 21*b* is input to the data input terminal D of the third D F/F 21*c*. And, the second D F/F 21*b* latches the first-delayed signal input at its input terminal D to its output terminal Q at the point in time when the vertical synchronization signal BVSY inversely input at the clock terminal CLK is changed from low state to high state, that is, at the rising edge of the inverted vertical synchronization signal BVSY Accordingly, the second D F/F 21*b* delays the first-delayed reset signal RESET again for a period corresponding to one vertical synchronization signal. In other words, the second D F/F 21*b* second delays the reset signal RESET.

The third D F/F 21*c* receives the reset signal RESET second-delayed at the output terminal Q of the second D F/F 21*b*, at its input terminal D. Further, the third D F/F 21*c* supplies the signal coming out at its output terminal Q to the data input terminal D of the fourth D F/F 21*d*. And, the third D F/F 21*c* latches the second-delayed signal input at its input terminal D to its output terminal Q at the point in time when the vertical synchronization signal BVSY inversely input at the clock terminal CLK is changed from low state to high state, that is, at the rising edge of the inverted vertical synchronization signal BVSY. Accordingly, the third D F/F 21*c* delays the second-delayed reset signal RESET, which is delayed by the first D F/F 21*a* and the second D F/F 21*b*, again for a period corresponding to one vertical synchronization signal. In other words, the third D F/F 21*c* third delays the reset signal RESET.

The fourth D F/F 21*d* receives the reset signal RESET third-delayed at the output terminal Q of the third D F/F 21*c*, at its input terminal D. Further, the fourth D F/F 21*d* supplies the signal coming out at its output terminal Q to the data input terminal D of the fifth D F/F 21E. And, the fourth D F/F 21*d* latches the third-delayed signal input at its input terminal D to its output terminal Q at the point in time when the vertical synchronization signal BVSY inversely input at the clock terminal CLK is changed from low state to high state, that is, at the rising edge of the inverted vertical synchronization signal BVSY. Accordingly, the fourth D F/F 21*d* delays the third-delayed reset signal RESET, which is delayed by the first D F/F 21*a* to the third D F/F 21*c*, again for a period corresponding to one vertical synchronization signal. In other words, the fourth D F/F 21*d* fourth delays the reset signal RESET.

The fifth D F/F 21*e* receives the reset signal RESET fourth-delayed at the output terminal Q of the fourth D F/F 21*d*, at its input terminal D. Further, the fifth D F/F 21*e* supplies the signal coming out at its output terminal Q to the data input terminal D of the sixth D F/F 21*f*. And, the fifth D F/F 21*e* latches the fourth-delayed signal input at its input terminal D to its output terminal Q at the point in time when the vertical synchronization signal BVSY inversely input at the clock terminal CLK is changed from low state to high state, that is, at the rising edge of the inverted vertical synchronization signal BVSY. Accordingly, the fifth D F/F 21*e* delays the fourth-delayed reset signal RESET, which is delayed by the first D F/F 21*a* to the fourth D F/F 21*d*, again for a period corresponding to one vertical synchronization signal. In other words, the fifth D F/F 21*e* fifth delays the reset signal RESET.

The sixth D F/F 21*f* receives the reset signal RESET fifth-delayed at the output terminal Q of the fifth D F/F 21*e*, at its input terminal D. Further, the sixth D F/F 21*f* supplies the signal coming out at its output terminal Q to the second inverter 23B. And, the sixth D F/F 21*f* latches the fifth-delayed signal input at its input terminal D to its output terminal Q at the point in time when the vertical synchronization signal BVSY inversely input at the clock terminal CLK is changed from low state to high state, that is, at the rising edge of the inverted vertical synchronization signal BVSY. Accordingly, the sixth D F/F 21*f* delays the fifth-delayed reset signal RESET, which is delayed by the first D F/F 21*a* to the fifth D F/F 21*e*, again for a period corresponding to one vertical synchronization signal. In other words, the sixth D F/F 21*f* sixth delays the reset signal RESET.

The second inverter 23*b* inverts the output signal delayed through the output terminal Q of the sixth D F/F 21*f*, and the inverted reset signal RESET is applied to the OR-gate 27. The OR-gate 27 performs logical sum operation on the output signals of second and third inverters 23*b* and 23*c* and a gate output enable input signal GOE_IN from the timing controller 29. In other words, the OR-gate 27 switches the gate output enable input signal GOE_IN in accordance with the logical state of the reset signal RESET delayed and inverted by each of the D F/F's 21 and the second inverter 23*b* and the reset signal RESET inverted by the third inverter 23*c*. As shown in FIG. 3, the gate enable signal is intercepted for the period of six vertical synchronization signals from the point in time when the reset signal is changed from low state to high state by the OR-gate 27.

As a result, the masking part, as shown in FIG. 3, further intercepts the gate output enable signal GOE for a period corresponding to the six vertical synchronization signal from the point in time when the reset signal is changed from low state to high state as well as for a period when the reset signal RESET remains at a low state. Thus, the masking part of the related art LCD masks the gate output enable signal GOE for a designated vertical synchronization period when the power source is applied, thereby preventing an overcurrent, which is generated at the near point in time when the power is applied, from being supplied. However, the gate high voltage (hereinafter referred to as Vgh) can have a voltage level lower than a specified voltage level due to the un-stability of power supply while the gate driver 3 is driven normally. When the gate high voltage Vgh is in an abnormal state, the overcurrent can flow into the circuit device of the gate driver 3 and the liquid crystal display panel 1 and the circuit device of the data driver 5. Such an overcurrent may cause a damage on the gate driver 5, the liquid crystal display panel 1 and the data driver 3.

SUMMARY OF THE INVENTION

Accordingly, the present invention is directed to a liquid crystal display and a driving method thereof that substantially obviate one or more of the problems due to limitations and disadvantages of the related art.

An object of the present invention to provide a liquid crystal display and a driving method thereof for protecting the liquid crystal display circuits from variations in gate high voltages.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other objects of the invention, a liquid crystal display according to an aspect of the present invention includes a gate driver driving gate lines on a liquid crystal display panel; a timing controller controlling the gate driver; and a masking part selectively intercepting a gate output enable signal corresponding to an abnormal state of a gate high voltage, wherein the gate output enable signal is supplied to the gate driver from the timing controller.

A driving method of a liquid crystal display according to another aspect of the present invention, comprising the steps of generating a gate voltage abnormality detection signal corresponding to an abnormal state of a gate high voltage; and selectively intercepting a gate output enable signal supplied from a timing controller to a gate driver, in accordance with the gate voltage abnormality detection signal.

It is to be understood that both the foregoing general description and the following detailed description are exemplary and explanatory, and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Reference will now be made in detail to the preferred embodiments of the present invention, examples of which are illustrated in the accompanying drawings.

Figure 1:
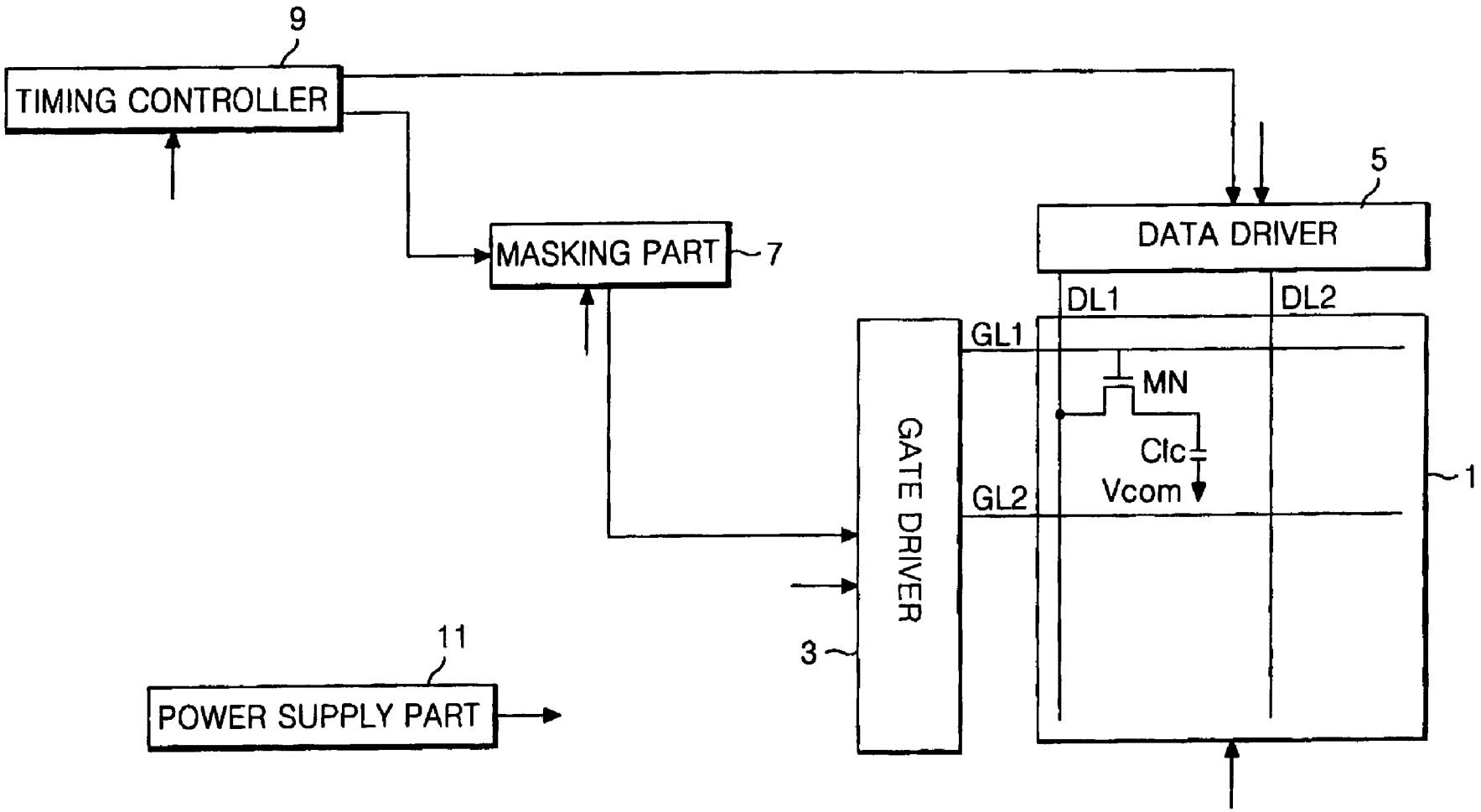
FIG. 1 RELATED ART
FIG. 1 is a block diagram illustrating a configuration of a liquid crystal display of the related art.
Figure 2:
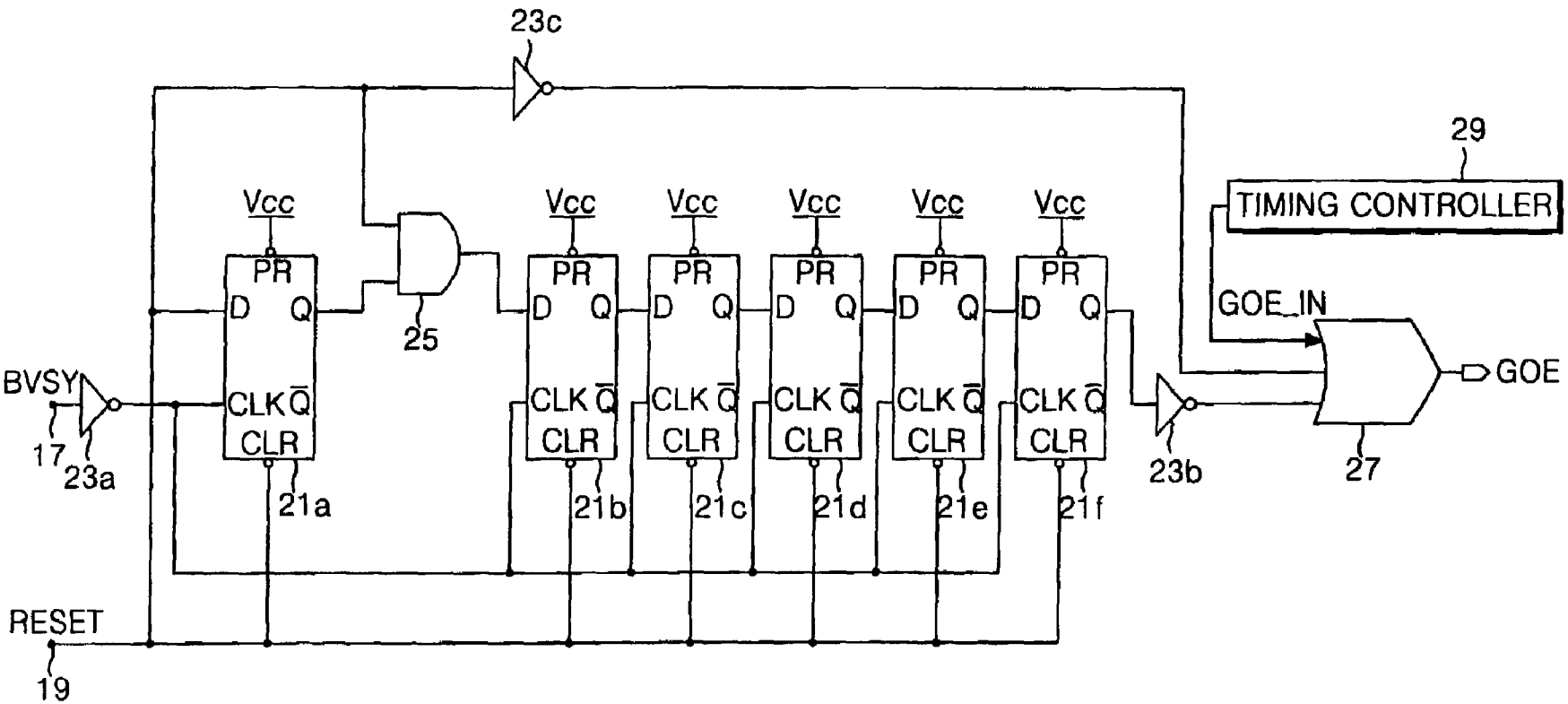
FIG.2 RELATED ART
FIG. 2 is a diagram illustrating a detailed configuration of a masking part in FIG. 1.
Figure 3:
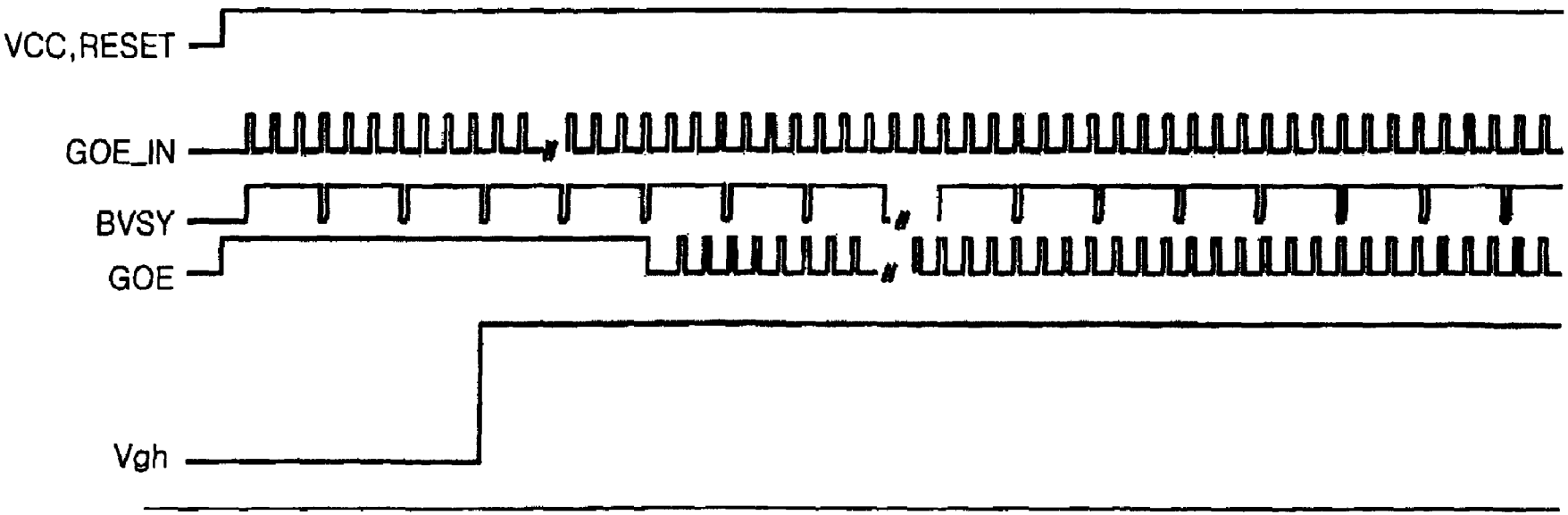
FIG. 3 RELATED ART
FIG. 3 is a waveform diagram of input and output signals of the masking part of FIG. 2.
Figure 4:
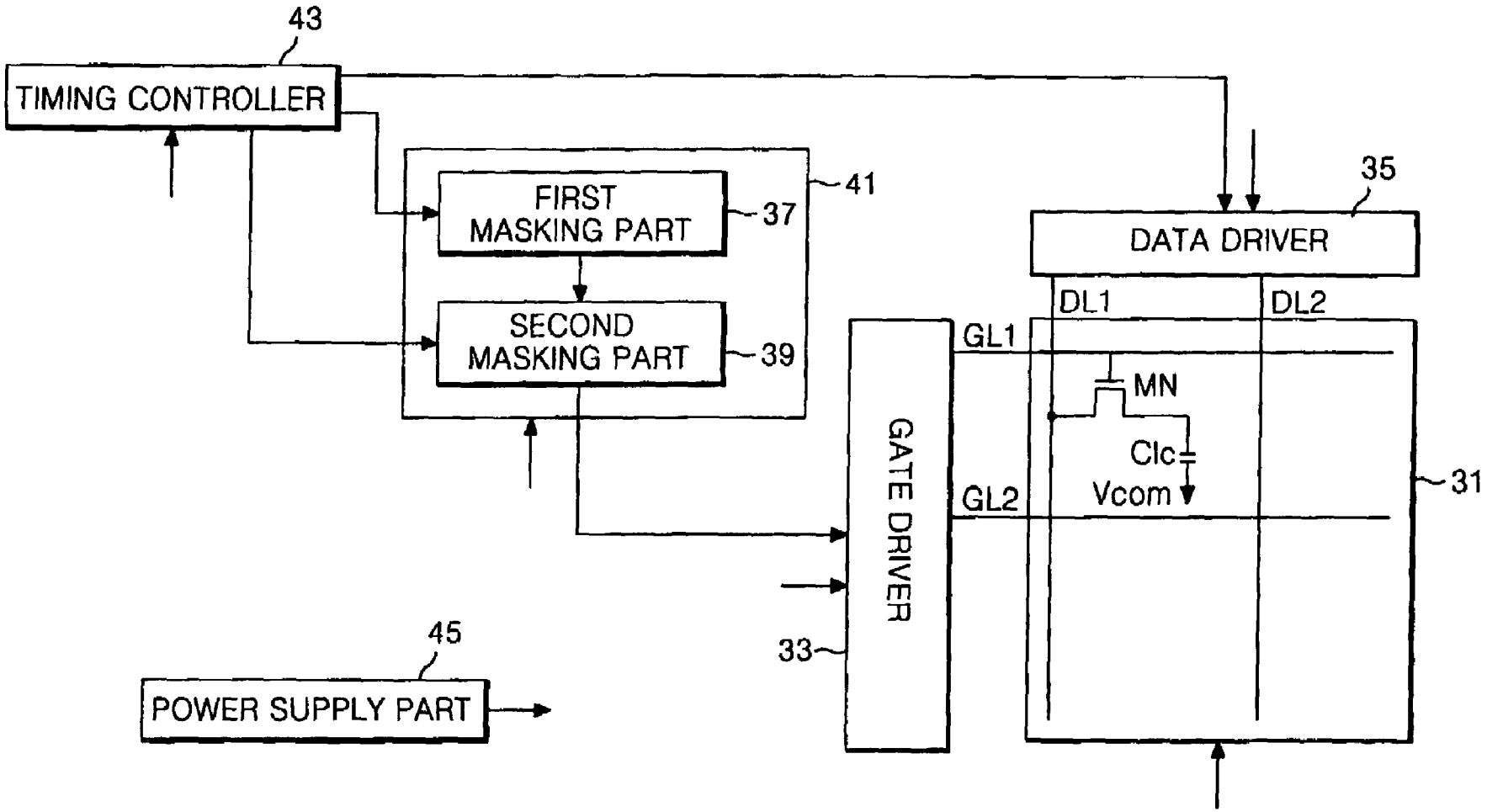
FIG. 4 is a block diagram illustrating a configuration of a liquid crystal display according to an embodiment of the present invention.

FIG. 4 is a block diagram schematically illustrating a configuration of a liquid crystal display according to an embodiment of the present invention. As shown in FIG. 4, the liquid crystal display LCD includes a liquid crystal display panel 31 in which liquid crystal cells are arranged in a matrix and a drive circuit to drive the liquid crystal display panel. The liquid crystal display panel includes a thin film transistor MN formed adjacent each intersection of gate lines GL1 and GL2, and data lines DL1 and DL2 to switch a signal voltage that is supplied to a liquid crystal cell Clc to control light transmittance of the liquid crystal cell Clc in accordance with the voltage level of each video signal.

In response to a gate signal from the gate line, the TFT MN supplies the video signal from the data line to the liquid crystal cell Clc. The liquid crystal cell Clc includes a common electrode and a pixel electrode (not shown), which face each other with liquid crystals therebetween. The pixel electrode (not shown) in connected to TFT MN. The pixel electrode is formed at a cell area defined by gate lines and data lines, which cross each other perpendicularly.

The drive circuit includes a gate driver 33 to drive the gate lines on the liquid crystal display panel 31, a data driver 35 to drive the data lines on the liquid crystal display panel 31, and a timing controller 43. The timing controller 43 supplies a timing control signal to the gate driver 33 and the data driver 35 to control them and, in addition, supplies a pixel data to the data driver 35. Further, the drive circuit includes a power supply 45 to supplies a power supply voltage for driving the whole system, and a masking part 41 to mask a gate output enable signal that is one of control signals to be applied to the gate driver 33.

The data driver 35 inputs a data control signal, such as a data clock, etc., together with red R, green G and blue B data signals from the timing controller 43. The data driver 35 acts to apply pixel signals corresponding to the pixel data of one line to the data line whenever the gate signal (or a scan signal) from the gate driver 33 is applied to the gate line.

The gate driver 33 sequentially applies the gate signal to the gate lines to sequentially drive the gate lines for each horizontal synchronization signal period. In other words, the gate driver 33 acts to generate the gate signal (or the scan signal) that sequentially selects the gate line. A gate high voltage is applied to each gate line only for the corresponding vertical synchronization period, and a gate low voltage is applied to each gate line for the remaining period. In response to the gate signal (or scan signal) input from the gate driver 33, the video data on the data line is supplied to the pixel electrode of the liquid crystal cell Clc through the TFT MN.

The timing controller 43 controls the drive timing of the gate driver 33 and the data driver 35 in response to horizontal and vertical synchronization signals and a data clock input from an external source, such as a graphic card within a computer system. To this end, the timing controller 43 generates the control signal necessary for the gate driver 33 and the data driver 35, inclusive of a gate output enable signal GOE and a data output enable signal, in use of the data clock and the horizontal and vertical synchronization signals. Further, the timing controller 43 supplies an input video data signal R, G and B from an external source to the data driver 35.

The power supply part 45 supplies a power supply voltage to each circuit part for driving the whole system. The masking part 41 selectively masks the gate output enable GOE signal that designates an output point in time of the gate driver 33 in response to the state of a reset signal RESET and the state of a gate high voltage Vgh. Such a masking part 41 includes a first masking part 37 responding to the reset signal and a second masking part 39 responding to the state of the gate high voltage.

Figure 5:
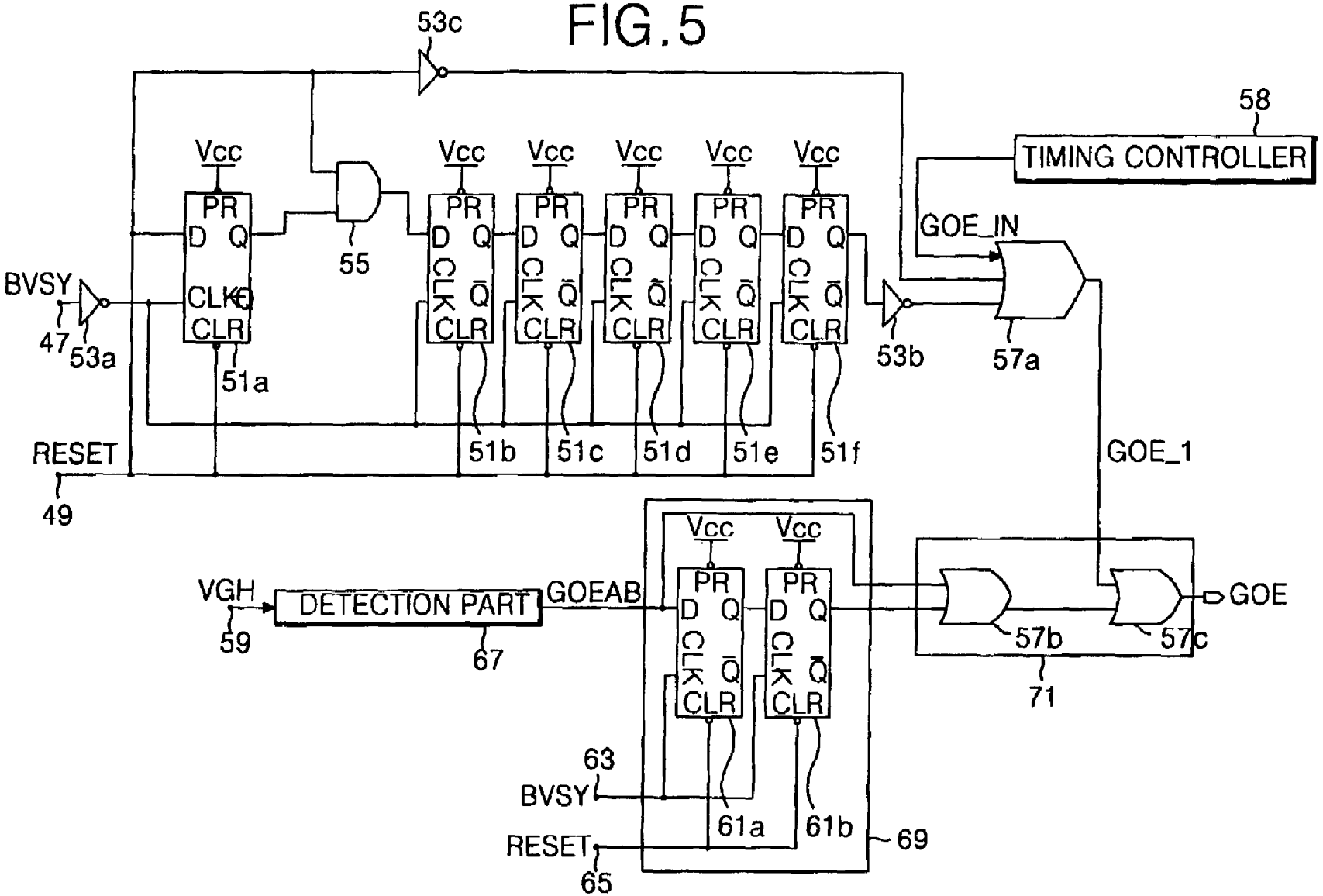
FIG. 5 is a diagram illustrating a detailed configuration of a masking part of FIG. 4.
Figure 6:
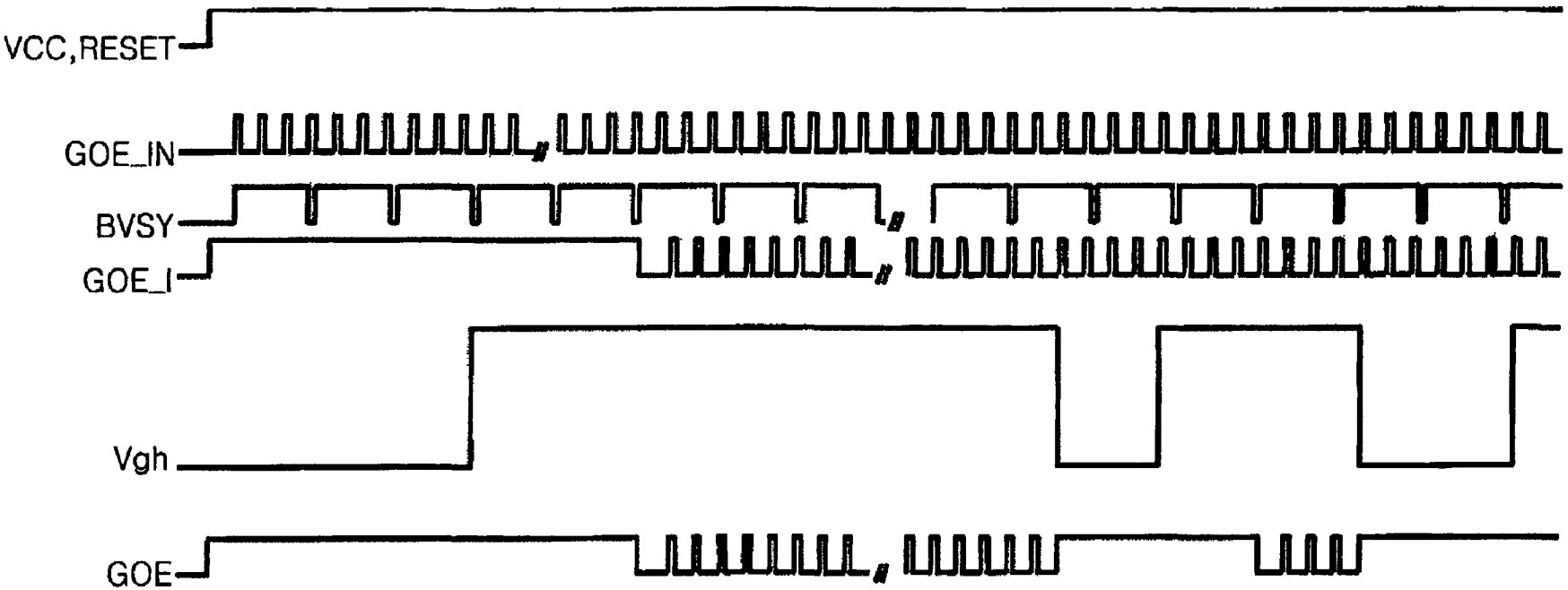
FIG. 6 is a waveform diagram of input and output signals of the masking part of FIG. 5.

FIG. 5 is a diagram illustrating a detailed configuration of a masking part according to an embodiment of the present invention. FIG. 6 is a waveform diagram of input and output signals of the masking part of FIG. 5. The masking part of FIG. 5 will be explained in conjunction with the waveform diagram shown in FIG. 6.

Referring to FIG. 5, the first masking part 37 includes a first D flip-flop 51*a* to a sixth D F/F 51*f* receiving a vertical synchronization signal BVSY at their clock terminal CLK through a first inverter 53*a* from a synchronization signal input terminal 47, and an AND-gate 55 to perform a logical product operation on a reset signal RESET from a reset input terminal 59 and an output signal of the first D F/F 51*a*. Further, the first masking part 37 includes an OR-gate 57*a* to switch the gate output enable signal GOE from the timing controller 58 in accordance with the output signals from second and third inverters 53*b* and 53*c*.

Each of the D F/F's 51*a–f* latches the input signal at its input terminal D to its output terminal Q at the point in time when the inverted vertical synchronization signal from the first inverter 53*a*, which is supplied to its clock terminal CLK, is changed from low state to high state, that is, at the rising edge of the inverted vertical synchronization signal BVSY. Further, each D F/F 51 receives the power supply voltage Vcc at its preset input terminal PR. In addition, each D F/F 51 receives the reset signal RESET at its clear terminal CLR. While the reset signal RESET is in a low logic state, each D F/F 51 initializes the output terminal Q and the inversion output terminal Q. A signal coming out from the inversion output terminal Q has an opposite polarity to the output signal from an output terminal Q.

Referring to FIG. 6, the power supply voltage Vcc and the reset signal RESET remain at a normal voltage since power is supplied. The first D F/F 51*a* receives the reset signal RESET from the reset input terminal 49 at its input terminal D, and inversely receives the vertical synchronization signal BVSY from the synchronization signal input terminal 47 at the clock terminal CLK through the first inverter 53*a*. Further, the first D F/F 51*a* latches the reset signal RESET input at its input terminal D to its output terminal Q at the point in time when the vertical synchronization signal BVSY inversely input at the clock terminal CLK is first changed from low state to high state, that is, at the rising edge of the inverted vertical synchronization signal BVSY. Accordingly, the first D F/F 51*a* delays the reset signal RESET for a period corresponding to one vertical synchronization signal.

The AND gate 55 is connected between the output terminal Q of the first D F/F 51*a* and the input terminal D of the second D F/F 51*b*, and performs a logical product operation on the reset signal RESET first-delayed at the output terminal Q of the first D F/F 51*a* and the reset signal RESET input from the reset input terminal 49. Further, the AND-gate 25 ensures that the signal output at the output terminal Q of the first D F/F 51*a* is input to the input terminal D of the second D F/F 51*b*. However, it is indifferent to the presence or absence of the AND-gate 25.

The second D F/F 51*b* receives the output signal, on which logical product operation is performed by the AND-gate 55, at its input terminal D and the inverted vertical synchronization signal BVSY at the clock terminal CLK through the first inverter 53*a*. The signal coming out at the output terminal Q of the second D F/F 51*b* is input to the data input terminal D of the third D F/F 51*c*. The second D F/F 51B latches the first-delayed signal input at its input terminal D to its output terminal Q at the point in time when the vertical synchronization signal BVSY inversely input at the clock terminal CLK is changed from low state to high state, that is, at the rising edge of the inverted vertical synchronization signal BVSY. Accordingly, the second D F/F 51*b* delays the first-delayed reset signal RESET again for a period corresponding to one vertical synchronization signal. In other words, the second D F/F 51*b* second delays the reset signal RESET.

The third D F/F 51*c* receives the reset signal RESET second-delayed at the output terminal Q of the second D F/F 51*b*, at its input terminal D. Further, the third D F/F 51*c* supplies the signal coming out at its output terminal Q to the data input terminal D of the fourth D F/F 51*d*. And, the third D F/F 51*c* latches the second-delayed signal input at its input terminal D to its output terminal Q at the point in time when the vertical synchronization signal BVSY inversely input at the clock terminal CLK is changed from low state to high state, that is, at the rising edge of the inverted vertical synchronization signal BVSY Accordingly, the third D F/F 51*c* delays the second-delayed reset signal RESET, which is delayed by the first D F/F 51*a* and the second D F/F 51*b*, again for a period corresponding to one vertical synchronization signal. In other words, the third D F/F 51*c* third delays the reset signal RESET.

The fourth D F/F 51*d* receives the reset signal RESET third-delayed at the output terminal Q of the third D F/F 51*c*, at its input terminal D. Further, the fourth D F/F 51*d* supplies the signal coming out at its output terminal Q to the data input terminal D of the fifth D F/F 51*e*. The fourth D F/F 51*d* latches the third-delayed signal input at its input terminal D to its output terminal Q at the point in time when the vertical synchronization signal BVSY inversely input at the clock terminal CLK is changed from low state to high state, that is, at the rising edge of the inverted vertical synchronization signal BVSY. Accordingly, the fourth D F/F 51*d* delays the third-delayed reset signal RESET, which is delayed by the first D F/F 51*a* to the third D F/F 51*c*, again for a period corresponding to one vertical synchronization signal. In other words, the fourth D F/F 51*d* fourth delays the reset signal RESET.

The fifth D F/F 51*e* receives the reset signal RESET fourth-delayed at the output terminal Q of the fourth D F/F 51*d*, at its input terminal D. Further, the fifth D F/F 51*e* supplies the signal coming out at its output terminal Q to the data input terminal D of the sixth D F/F 51*f*. And, the fifth D F/F 51*e* latches the fourth-delayed signal input at its input terminal D to its output terminal Q at the point in time when the vertical synchronization signal BVSY inversely input at the clock terminal CLK is changed from low state to high state, that is, at the rising edge of the inverted vertical synchronization signal BVSY. Accordingly, the fifth D F/F 51*e* delays the fourth-delayed reset signal RESET, which is delayed by the first D F/F 51*a* to the fourth D F/F 51*d*, again for a period corresponding to one vertical synchronization signal. In other words, the fifth D F/F 51*e* fifth delays the reset signal RESET.

The sixth D F/F 51*f* receives the reset signal RESET fifth-delayed at the output terminal Q of the fifth D F/F 51*e*, at its input terminal D. Further, the sixth D F/F 51*f* supplies the signal coming out at its output terminal Q to the second inverter 53*b*. And, the sixth D F/F 51*f* latches the fifth-delayed signal input at its input terminal D to its output terminal Q at the point in time when the vertical synchronization signal BVSY inversely input at the clock terminal CLK is changed from low state to high state, that is at the rising edge of the inverted vertical synchronization signal BVSY. Accordingly, the sixth D F/F 51*f* delays the fifth-delayed reset signal RESET, which is delayed by the first D F/F 51*a* to the fifth D F/F 51*e*, again for a period corresponding to one vertical synchronization signal. In other words, the sixth D F/F 51*f* sixth delays the reset signal RESET.

The second inverter 53*b* inverts the output signal delayed through the output terminal Q of the sixth D F/F 51*f*. The inverted reset signal RESET is applied to a first OR-gate 57*a*. The first OR-gate 57*a* performs logical sum operation on the output signals of second and third inverters 53*b* and 53*c* and a gate output enable input signal GOE_IN from the timing controller 58. In other words, the first OR-gate 57*a* switches the gate output enable input signal GOE_IN in accordance with the logical state of the reset signal RESET delayed and inverted by each of the D F/F's 51 and the second inverter 53*b* and the reset signal RESET inverted by the third inverter 53*c*.

As shown in FIG. 6, the gate enable signal is intercepted for the period of six vertical synchronization signals from the point in time when the reset signal is changed from low state to high state by the first OR-gate 57*a*. As a result, the masking part intercepts the gate output enable signal GOE for a period corresponding to the six vertical synchronization signals from the point in time when the reset signal is changed from low state to high state as well as for a period when the reset signal RESET remains at a low state. On the other hand, referring to the second masking part shown in FIG. 5, the second masking part 39 includes a detection part 67 detecting an abnormal period of gate high voltage to generate a gate voltage abnormality detection signal GOEAB, a period-extending part 69 to extend the output signal of the detection part 67 for a designated period, and a switching part 71 to switch a gate output enable signal GOE_1 first masked by the output signal of the detection part 67 and the period extension part 69.

The detection part 67 detects through an input terminal 59 of the gate high voltage VGH whether the gate high voltage VGH remains at or drops below a designated voltage. The detection part 67 generates a gate voltage abnormality detection signal GOEAB of low logical state in a normal state where the gate high voltage VGH remains at the designated or higher voltage, and generates a gate voltage abnormality detection signal GOEAB of high logical state in an abnormal state where the gate high voltage VGH drops below the designated voltage. The period extending part 69 includes two of the D F/F's 61 connected in series to the output terminal of the detection part 67.

The first D F/F 61*a* receives the gate voltage abnormality detection signal GOEAB from the output terminal of the detection part 67 at its input terminal D, and the vertical synchronization signal BVSY from the synchronization input terminal 63 at the clock terminal CLK. The first D F/F 61*a* latches the gate voltage abnormality detection signal GOEAB input at its data input terminal D from the detection part 67 to its output terminal Q to be synchronized with the vertical synchronization signal BVSY. In other words, the first D F/F 61*a* delays the gate voltage abnormality detection signal GOEAB for a period corresponding to one vertical synchronization signal.

The second D F/F 61*b* receives the gate voltage abnormality detection signal GOEAB first delayed at the first D F/F 61*a* at its data input terminal D, and the vertical synchronization signal BVSY from the synchronization signal input terminal 63 at its clock terminal CLK. Then, the second D F/F 61*b* latches the gate voltage abnormality detection signal GOEAB input at its data input terminal D from the output terminal Q of the first D F/F 61*a* toward its output terminal Q. In other words, the second D F/F 61*b* delays the gate voltage abnormality detection signal GOEAB again for a period corresponding to one vertical synchronization signal. The second D F/F 61*b* supplies the re-delayed gate voltage abnormality detection signal GOEAB to the OR-gate 57*b*. As a result, the first and second D F/F 61*a* and 61*b* delays the gate voltage abnormality detection signal GOEAB from the detection part 67 for a period corresponding to two vertical synchronization signals BVSY.

The switching part 71 includes two OR-gates 57*b* and 57*c* connected in series to the second D F/F 61*b*. The second OR-gate 57*b* performs logical sum operation on the gate voltage abnormality detection signal GOEAB from the detection part 67 and the delayed gate voltage abnormality detection signal GOEAB from the output terminal Q of the second D F/F 61*b*. In other words, the second OR-gate 57*b* sets the second masking period by the gate voltage abnormality detection signal GOEAB from the detection part 67 and the gate voltage abnormality detection signal GOEAB delayed at the output terminal Q of the second D F/F 61*b*. The second masking period is a sum of a period when the gate high voltage is abnormal and a period corresponding to the two vertical synchronization signals.

The third OR-gate 57*c* performs logical sum operation on the output signal of the second OR-gate 57*b* and the gate output enable signal GOE_1 first masked at the first OR-gate 57*a*. As a result, the first masked gate output enable signal GOE_1 is shielded for a second masking period set by the second OR-gate 57*b*. Accordingly, the second masking part 39 masks the first masked gate output enable signal GOE_1 again not only for the abnormal period and but also for the period corresponding to the two vertical synchronization signals. Thus, the GOE masking part 41 selectively masks the gate output enable signal GOE, which is one of timing control signals.

Figure 7:
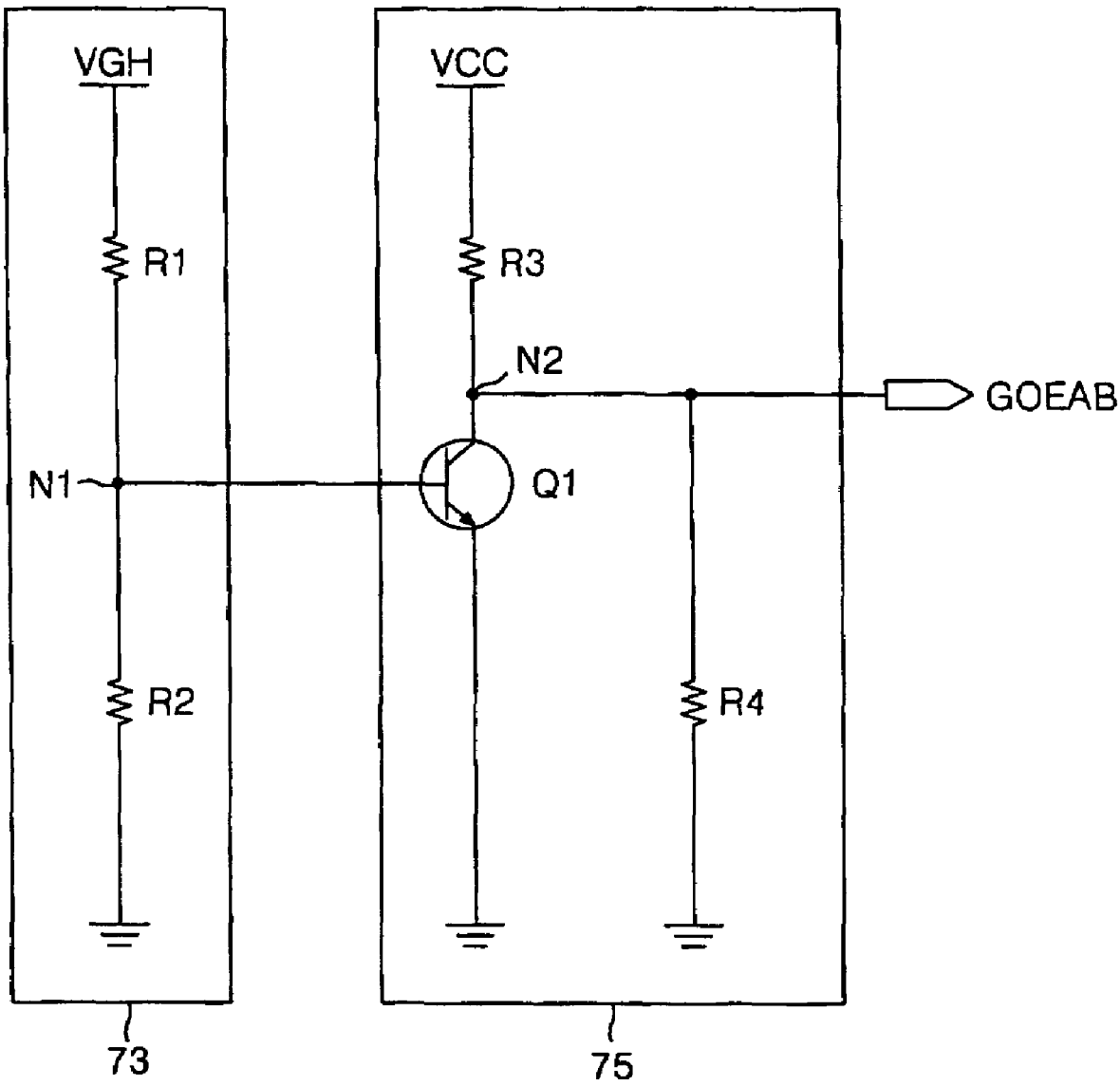
FIG. 7 is a diagram illustrating a detailed configuration of a detection part of FIG. 5.

FIG. 7 is a diagram illustrating an example of a detailed configuration of the detection part 57 of FIG. 5. As shown in FIG. 7, the detection part includes a sensing part 73 to sense the voltage level of the gate high voltage, and a logical signal generator 75 generating logical signals in accordance with the voltage level sensed by the sensing part 73. The sensing part 73 has first and second resistors R1 and R2 connected in series between the gate high voltage VGH and the ground voltage GND. A voltage applied between the gate high voltage VGH and the ground voltage GND is divided by the first resistor R1 and the second resistor R2, which are connected in series. The divided voltage is supplied to a base terminal of a transistor Q1 through a node N1.

If the gate high voltage VGH is a normal voltage remaining at a designated or higher voltage, the voltage applied to the node N1 of the first and second resistors R1 and R2 is higher than a threshold voltage. The voltage higher than such a threshold voltage causes the transistor Q1 to be turned on. At this moment, the gate voltage abnormality detection signal GOEAB of low logical state is supplied to the first D F/F 61*a* and the second OR-gate 57*b*.

On the other hand, if the gate high voltage VGH drops below the designated voltage, the voltage applied to the node N1 of the first and second resistors R1 and R2 is lower than the threshold voltage. The voltage lower than such a threshold voltage causes the transistor Q1 to be turned off. Accordingly, the first D F/F 61*a* and the second OR-gate 57*b* are supplied with the gate voltage abnormality detection signal GOEAB of high logical state representing that there is an abnormality about the gate high voltage VGH.

The transistor Q1 has a threshold voltage. If the voltage divided by the sensor 73 is higher than the threshold voltage, the transistor Q1 is turned on. If the transistor Q1 is turned on, the power supply voltage Vcc provides current through the third resistor R3 and the collector and emitter of the transistor Q1 to the ground voltage GND. Accordingly, the gate voltage abnormality detection signal GOEAB is in a low state representing that the gate high voltage VGH is in a normal state.

On the other hand, if the voltage divided at the sensor 73 is below the threshold voltage, the transistor Q1 is turned off. If the transistor Q1 is turned off, a voltage is divided at the third and forth resistors R3 and R4, so the divided voltage appears at the node N2. Accordingly, the gate voltage abnormality detection signal GOEAB appearing at the node N2 comes to be in a high state representing that the gate high voltage VGH is in an abnormal state. The transistor Q1 operates in this way to make up the logical signal generator together with third and fourth resistors R3 and R4. The transistor Q1 is used as a switching device, the third resistor R3 is used as a pull-up resistor, and the fourth resistor R4 is used as an output resistor of the transistor Q1.

Figure 8:
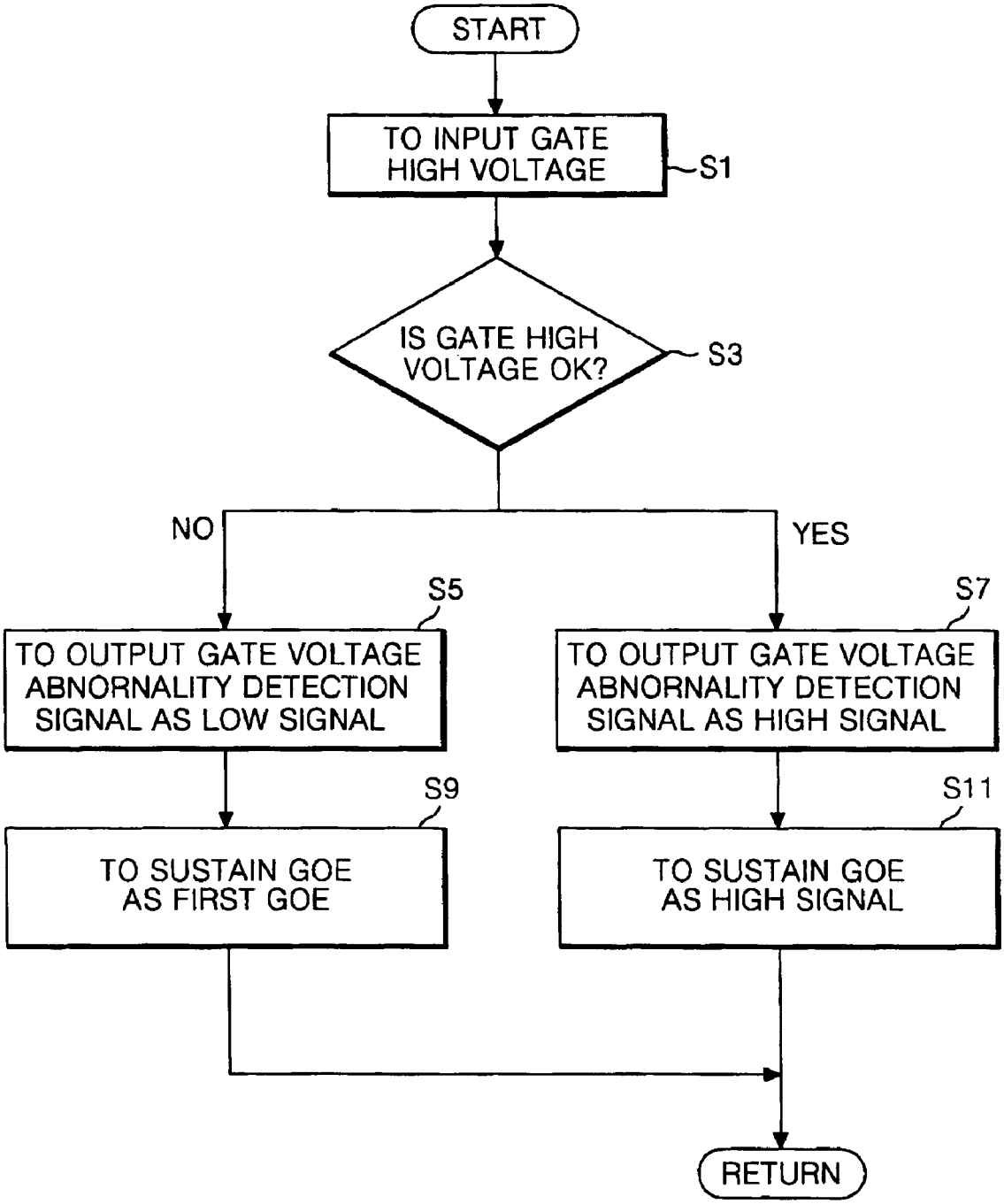
FIG. 8 is a flow chart illustrating a driving method of a liquid crystal display step by step according to an embodiment of the present invention.

FIG. 8 is a flow chart illustrating a driving method of a liquid crystal display step by step according to an embodiment of the present invention. In a first step S1, the gate high voltage VGH is applied to a gate high voltage VGH input terminal 59 of the detection part 67. In a third step S3, it is determined whether the applied gate high voltage VGH is in the normal state where the gate high voltage VGH remains above the threshold voltage, or is in the abnormal state where the gate high voltage VGH drops below the threshold voltage. If the gate high voltage VGH input at the third step S3 is a voltage of normal state that remains above the threshold, the gate voltage abnormality detection signal GOEAB remains at the low state (step S5).

On the other hand, if the gate high voltage VGH input at the third step S3 is a voltage of abnormal state that drops below the threshold, the gate voltage abnormality detection signal GOEAB remains at the high state (step S7). Further, if the gate voltage abnormality detection signal GOEAB output at the fifth step S5 is in the low state (that is, the gate high voltage VGH is a voltage of normal state that remains above the threshold), the output signal of the first masking part 37, such as the first-masked gate output enable signal GOE_1 is output as the final gate output enable signal (step S9).

If the gate voltage abnormality detection signal GOEAB output at the seventh step S7 is in the high state (that is, such as the gate high voltage VGH is a voltage of abnormal state where the gate high voltage VGH drops below the threshold voltage), the output signal of the final gate output enable signal GOE is intercepted during the period of the abnormal state when the gate high voltage VGH drops below the designated voltage level (step S11). This sequence returns to repeat the above operation.

As described above, the liquid crystal display according to the present invention masks the gate output enable signal GOE to prevent overcurrent from being generated when the gate high voltage VGH drops from high state to low state due to the un-stability of power supply. Such a masking protects the circuit devices of the liquid crystal display, such as the gate driver, the liquid crystal display panel and the data driver. As a result, the reliability of the liquid crystal display can be improved.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display, comprising:

a gate driver driving gate lines on a liquid crystal display panel;

a timing controller controlling the gate driver; and a masking part selectively intercepting a gate output enable signal corresponding to an abnormal state of a gate high voltage, wherein the gate output enable signal is supplied to the gate driver from the timing controller.

2. The liquid crystal display according to claim 1, wherein the masking part intercepts the gate output enable signal during an abnormal period when the gate high voltage drops below a designated voltage.

3. The liquid crystal display according to claim 1, wherein the masking part includes:

a detection part detecting an abnormal period of the gate high voltage to generate a gate voltage abnormality detection signal; and a switching part switching the gate output enable signal and the gate voltage abnormality detection signal in accordance with the gate voltage abnormality detection signal.

4. The liquid crystal display according to claim 3, further comprising:

a period-extending part connected between the detection part and the switching part for further extending a period, during which the gate output enable signal is intercepted, by a designated period in use of the gate voltage abnormality detection signal.

5. The liquid crystal display according to claim 4, wherein the period-extending part delays the gate voltage abnormality detection signal for the designated period to supply the delayed gate voltage abnormality detection signal to the switching part.

6. The liquid crystal display according to claim 3, wherein the detection part includes:

a sensing part sensing a voltage level of the gate high voltage; and a logical signal generator for generating the gate voltage abnormality detection signal with any one logical state of high state or low state in accordance with the voltage level of the sensed gate high voltage to supply the generated gate voltage abnormality detection signal to the switching part.

7. The liquid crystal display according to claim 2, further comprising:

a second masking part selectively intercepting the gate output enable signal supplied from the timing controller to the masking part, in accordance with a reset signal.

8. A driving method of a liquid crystal display, comprising the steps of:

generating a gate voltage abnormality detection signal corresponding to an abnormal state of a gate high voltage; and selectively intercepting a gate output enable signal supplied from a timing controller to a gate driver in accordance with the gate voltage abnormality detection signal.

9. The driving method according to claim 8, wherein the gate output enable signal is intercepted during an abnormal period when the gate high voltage drops below a designated voltage, in the step of selectively intercepting the gate output enable signal.

10. The driving method according to claim 8, wherein the step of generating the gate voltage abnormality detection signal includes:

sensing a voltage level of the gate high voltage; and generating the gate voltage abnormality detection signal with any one logical state of high state or low state in accordance with the sensed voltage level.

11. The driving method according to claim 8, further comprising the step of:

having the gate output enable signal further intercepted for a designated period in response to the gate voltage abnormality detection signal.

12. The driving method according to claim 8, wherein the gate output enable signal is output to the gate driver if the gate high voltage is in a normal state and is intercepted if the gate high voltage is in an abnormal state during the step of selectively intercepting the gate output enable signal.

* * * * *